US007913421B2

(12) United States Patent
Malenotti

(10) Patent No.: US 7,913,421 B2
(45) Date of Patent: Mar. 29, 2011

(54) FOOTWEAR SOLE WITH VENTILATION INDUCED BY THE VENTURI EFFECT

(76) Inventor: Franco Malenotti, Noale (IT)

( * ) Notice: Subject to any disclaimer, the term of this patent is extended or adjusted under 35 U.S.C. 154(b) by 686 days.

(21) Appl. No.: 11/749,684

(22) Filed: May 16, 2007

(65) Prior Publication Data

US 2007/0283593 A1 Dec. 13, 2007

(30) Foreign Application Priority Data

May 19, 2006 (IT) ..... TV2006A0084

(51) Int. Cl.
*A43B 7/06* (2006.01)

(52) U.S. Cl. ..... 36/3 B; 36/131

(58) Field of Classification Search ..... 36/3 R, 36/3 B, 29, 35 B, 147, 131
See application file for complete search history.

(56) References Cited

U.S. PATENT DOCUMENTS

| | | | | |
|---|---|---|---|---|
| 1,852,883 | A * | 4/1932 | Gustaveson | 36/3 B |
| 2,098,412 | A * | 11/1937 | Bovay | 36/3 R |
| 3,012,342 | A * | 12/1961 | Ramirez | 36/3 B |
| 4,078,321 | A * | 3/1978 | Famolare, Jr. | 36/3 B |
| 4,100,685 | A * | 7/1978 | Dassler | 36/3 B |
| 4,587,749 | A | 5/1986 | Berlese | |
| 4,640,027 | A | 2/1987 | Berlese | |
| 6,305,100 | B1 * | 10/2001 | Komarnycky et al. | 36/3 R |
| 6,655,048 | B2 * | 12/2003 | Moretti | 36/3 R |
| 6,711,832 | B2 * | 3/2004 | Chen | 36/3 R |
| 6,948,260 | B2 * | 9/2005 | Lin et al. | 36/3 B |
| 7,328,525 | B2 * | 2/2008 | Lim | 36/3 B |
| 7,340,850 | B2 * | 3/2008 | Lin et al. | 36/3 R |
| 2001/0003875 | A1 * | 6/2001 | Moretti | 36/3 B |
| 2005/0160623 | A1 * | 7/2005 | Liou | 36/3 B |
| 2005/0217140 | A1 * | 10/2005 | Melis | 36/3 B |

FOREIGN PATENT DOCUMENTS

| | | |
|---|---|---|
| CH | 653533 | 1/1986 |
| GB | 512046 | 8/1939 |

* cited by examiner

*Primary Examiner* — Jila M Mohandesi
(74) *Attorney, Agent, or Firm* — Egbert Law Offices PLLC

(57) ABSTRACT

Sole for footwear with ventilation induced by the Venturi effect is the present invention. An insole is superimposed that includes a plurality of holes for the passage of air from the sole towards the interior of the shoe. The sole includes at least one inlet opening placed on the lateral frontal surface and at least one outlet opening placed on the back lateral surface. The inlet opening and outlet opening of an airflow channel are each provided respectively with a sliding shutter that reduces the incoming airflow and a sliding shutter that reduces the outgoing airflow and a plurality of air inlet holes made on the insole to make the air enter and exit in correspondence with the foot.

6 Claims, 2 Drawing Sheets

FOOTWEAR SOLE WITH VENTILATION INDUCED BY THE VENTURI EFFECT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention finds particular although not exclusive application in the footwear sector and in the sector concerning the components constituting the structure of a shoe.

Its main application is particularly found in the technical-sport sector for clothing for use in motorcycling.

2. Description of Related Art Including Information Disclosed Under 37 CFR 1.97 and 37 CFR 1.98

The object of this invention is a technical footwear sole with ventilation induced by the Venturi effect.

The sole is a fundamental component in footwear. This sole is the part placed directly in contact with the ground, therefore its lower surface is characterized by numerous projections and grooves for the most part aimed at increasing the adherence of the footwear to the underlying ground.

The known art presents innumerable forms and structures of soles for footwear, solutions that are differentiated from each other by the type of footwear, namely classic, casual, sports and technical.

In particular, the motorcycling footwear sector presents a specific demand for boots provided with good internal ventilation. This demand is essentially due to the fact that the foot suffers to a certain extent as a result of the lack of internal ventilation because of high temperatures in the summer season, because the upper part of this specific type of footwear is generally made of leather, leathercloth or some variation with certain portions made of leather combined with technical parts in metal or plastic materials with high resistance to wear and friction, and because of climatic conditions and natural sweating by the foot. With the purpose of avoiding this disadvantage, some solutions have been suggested, such as essentially providing air ducts having a channelling function, namely to inwardly conduct, in an opportune way, strong airflow involving the exterior of the footwear while the motor vehicle is in motion.

Applications concerning airflow ducts are also found in sports and classic footwear. For example, in Swiss Patent No. CH653533 by Favini, airflow ducts comprises a series of parallel channels running longitudinally along the sole of the footwear, and air vents placed vertically behind the heel of the footwear are provided. The air vents are activated by means of a suction action produced by the alternation of pressure on the sole while walking.

British Patent No. GB512046 by Roselli also describes an internal ventilation system for sports footwear provided with a series of parallel channels of external air vents arranged laterally, external to the upper and also activated by means of a suction action produced by the pressure of the foot on the sole while walking.

The prior art further includes technical solutions provided with airflow inlet openings placed on the boot-top of the boot that subsequently conduct the air to the interior of the footwear, by means of vertical channels.

U.S. Pat. No. 4,587,749 (Berlese) in fact describes a boot for technical-motorcycling clothing provided with two external air inlet ducts placed at the top of the boot-top, comprising a horizontal entry that subsequently develops vertically, running along the entire boot-top, with internal air inlet points of which one is placed in the vicinity of the heel for the ventilation of the back of the footwear and one placed in an intermediate position in the footwear for the ventilation of the front of said footwear.

The prior art most similar to the object of this invention, in the opinion of the applicant, is described in U.S. Pat. No. 4,640,027 (Berlese). The patent mentioned describes a solution in the form of a boot for technical-motorcycling clothing provided with two horizontal air entries placed at the top of the boot-top that conduct the airflow that runs through the footwear towards the entry, by means of a single vertical duct. At the height of the sole, the duct meets a central channel, running along the upper surface of the sole. In the extreme front position, it divides into two return channels placed along the lateral edges of the footwear that in turn end with another two vertical channels placed next to the aforementioned vertical inlet duct. The horizontal portions of the channels described, placed above the sole, are equipped with internal ventilation holes. In particular, the central one is for air inlet, and those placed laterally for internal air suction are for subsequent expulsion through the return channels. The writer states that the air expulsion effect can be favored by the Venturi effect that is generated at the air entrances on entry.

All this considered, it is possible to affirm reasonably that:

soles are known for footwear provided with a ventilation system including a series of internal aeration channels and holes;

internal structures are known for footwear provided with a ventilation system including a series of channels that suck the external air while walking due to the effect of the alternated pressure of the foot on the sole, and aeration holes for internal distribution and diffusion; and soles are known for footwear that are provided with a ventilation system consisting of a pneumatic circuit including a series of channels that transmit, to the interior of the footwear, the airflow involving the external surface of same. Other channels are instead connected to the first pneumatically that allow the expulsion of the internal air, aided by a Venturi effect that is put into effect at the entrance of the inlet channels of the air circuit.

It has been seen in principle that well-known products can offer good applicative solutions for footwear soles provided with systems for internal ventilation including air distribution channels and holes. However, the solutions known particularly in the motorcycling sector fail to exploit and fail to completely optimize the natural airflow that runs externally to the boot itself, to obtain an internal ventilation benefit in the interior of the footwear.

The technique described in CH653533 (Favini) and in GB512046 (Roselli), presents internal ventilation systems that are activated by the alternated pressure of the foot on the sole of the footwear, while walking. An action produces the suction of the external air through the channels placed in the sole or laterally on the upper.

On the contrary, the boot described in U.S. Pat. No. 4,587,749 (Berlese) only obtains partial internal ventilation efficiency, since the air ducts enter into the interior of the footwear in two localized points. Moreover, the external air inlet channel does not appear to be placed in an optimal position in order to be able to be involved by a sufficient external airflow.

Also, U.S. Pat. No. 4,640,027 (Berlese) does not appear to offer an efficient ventilation system since the Venturi effect mentioned in the patent specification will partially be implemented during the use of the described boot. Since a narrowing of the passage section is not indicated at any point, it is given that the channels described all seem to present the same section. The Venturi effect that is mentioned should originate near the entrance of the air inlet channels and should therefore facilitate air circulation in the circuit and its subsequent expulsion from the boot. The internal ventilation, however, may remain limited since there are few inlet holes on the interior of the boot with respect to the whole surface of the footwear, and they are only located in a central position.

Finally, all the solutions described present the disadvantage ofpossible accidental migrations of rainwater into the interior of the footwear, by means of air inlet entrances.

Therefore the need arises for companies, particularly in the sector, to identify more effective alternative solutions that encapsulate all the functionalities already mentioned, with respect to the solutions in existence until now.

The aim of this invention is also to avoid the drawbacks described.

BRIEF SUMMARY OF THE INVENTION

This and other aims are reached with this invention according to the characteristics as in the included claims, resolving the arising problems by means of a sole for footwear with ventilation induced by the Venturi effect to which an insole is superimposed that includes a plurality of air passage holes from the sole towards the interior of the footwear. The sole comprises at least one inlet opening placed on the lateral frontal surface and at least one outlet opening placed on the back lateral surface. Each of the inlet opening and outlet opening, of an airflow channel, are provided respectively with a sliding shutter reducing the incoming airflow, a sliding shutter reducing the outgoing airflow, and a plurality of air inlet holes made on the insole to make the air enter and exit in correspondence with the foot.

In this way, by means of the considerable creative contribution whose effect has allowed certain considerable technical progress to be reached, some aims and advantages have been achieved.

A first aim intends to obtain a sole for footwear with excellent internal ventilation efficiency capable of transmitting to the interior (above all in technical motorcycling footwear) the strong air flow impacting on the front part of the footwear itself, by means of channels with a suitable section and longitudinal arrangement in such a way as to completely use the formation of the Venturi effect generated by the external air flow.

A second aim intends to limit as far as possible the length of the internal ventilation ducts in such a way that the speed acquired by the air due to the Venturi effect does not decrease excessively and is easily diffused in the interior of the shoe, so as to guarantee sufficient air ventilation and distribution in the interior and in a large part of the footwear itself.

An additional aim is to obtain a sole for footwear that will avoid or reduce the possibility of accidental migrations of water into the channels, by means of the air openings with which the footwear itself is provided.

Finally, a purpose of considerable importance consists of obtaining a product that can be constructed economically, with a limited number of pieces, and that can be reproduced on a industrial scale so that the whole ventilation system is contained in the interior of the sole.

In conclusion, it was possible to obtain a technical sole for footwear provided with an integrated and compact ventilation system including a system of channels, that by using the Venturi effect, guarantee efficient and constant air ventilation in the interior of the footwear. A sole of the present invention does not allow accidental migrations of water through the aeration openings and can be constructed economically.

These and other advantages will appear from the following detailed description of certain preferred embodiments, with the aid of the enclosed schematic drawings whose implementation details are not to be considered as restrictive but only as illustrative.

DETAILED DESCRIPTION OF THE INVENTION

The object of this invention is a sole for footwear with ventilation induced by the Venturi effect.

The sole, that is described in the following, finds particular use and application in the sector of technical-sports clothing.

Figure 1:
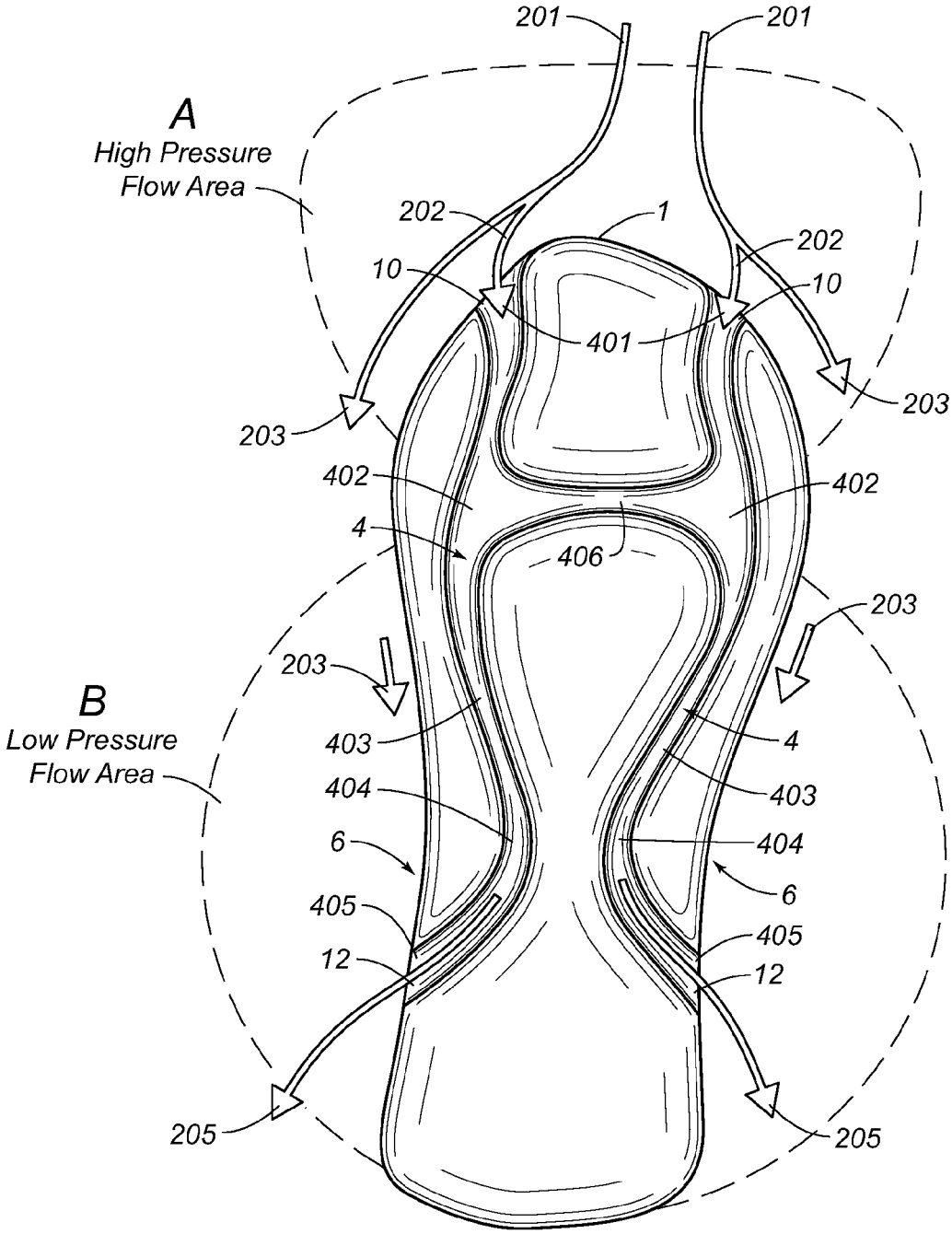
FIG. 1 is bottom view of the sole that is the object of this invention.
Figure 2:
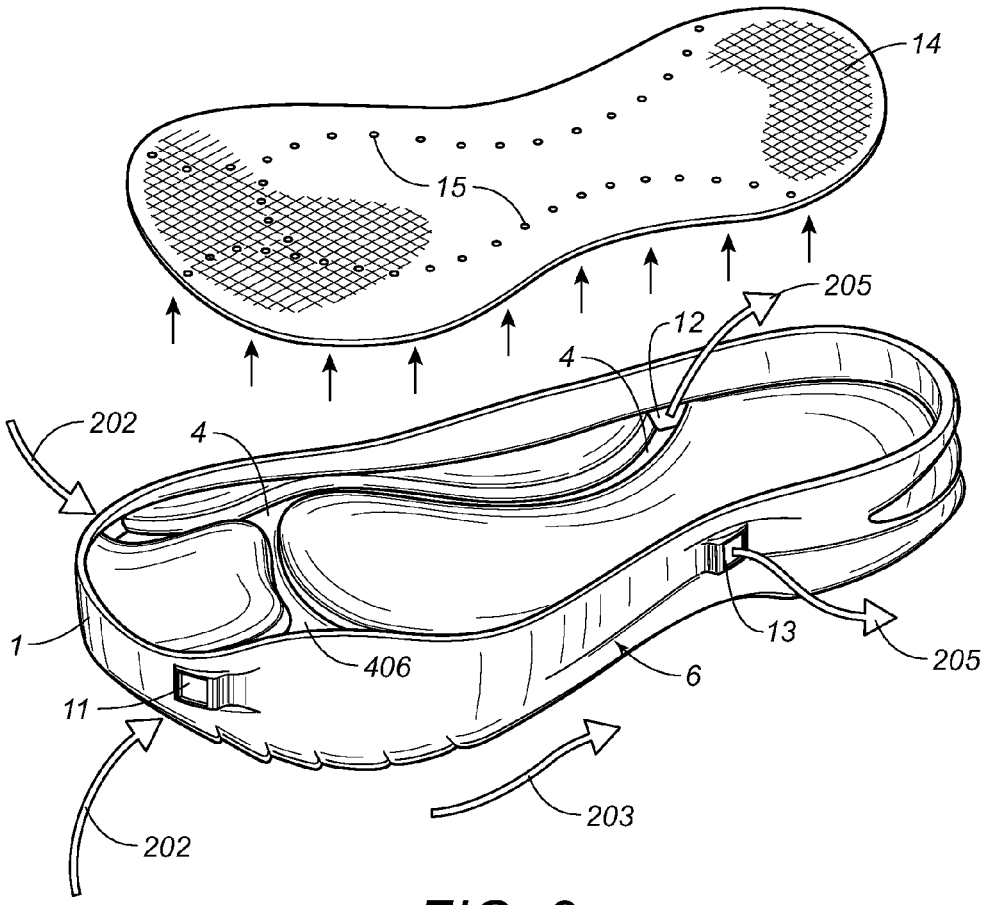
FIG. 2 illustrates, in a exploded and perspective view, the sole and the insole of the invention that is the object of the invention.
Figure 3:
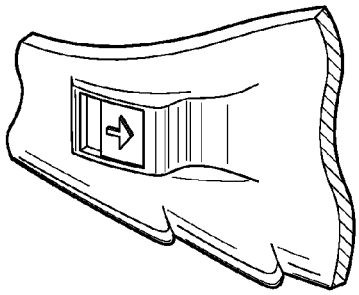
FIG. 3 illustrates an enlarged detailed side view of the sole in FIG. 2.

The sole (FIG. 1) essentially consists of a plastic material structure with a particular external profile, on the interior of which channels 4 are obtained for airflow.

The particular shape of the external lateral profile of the toe of the sole is made in such a way that the strong air flow 201, involving the front part and the toe of the footwear, creates a high pressure area when impacting with the frontal surface 1. At the same time, the strong air flow 201 partially subdivides into incoming airflow portions 202 on the interior of inlet openings 10, of which there are two that are mirror images made on the front surface on the lateral-frontal part 1 of the sole that is the object of the invention. The remaining air flow portions 203 skim the lateral surface of the sole that is the object of the invention, increasing speed and therefore creating, by means of the known Venturi effect, an area of low pressure in correspondence with the lateral areas of the sole.

The entrance openings 10 are provided with convenient shutters 11 that can slide with a release and that can also be opened partially or manually closed by the user according to necessity and are suitable therefore for avoiding possible accidental migrations of water in the case of rain.

The airflows 202 entering through the inlet openings 10 and involving the channels 4, first meet the areas 401 for entry, and subsequently the connecting areas 402, the end portions of a transverse channel 406. From the connecting areas 402, the air meets the rectilinear channel portions 403 and subsequently the curves 404, placed in the immediate proximity of the outlet areas 405 close to the outlet openings 12 that are positioned on the back lateral surface 6 of the sole that is the object of the invention. In this case, each outlet opening 12 is obtained in a mirrored way with respect to the other in correspondence with the back lateral part of the sole in a position close to and next to the heel area.

The air passing through the channels 4 naturally passes through the insole 14 by means of a plurality of holes 15 made on said insole 14 along imaginary lines running across the course of said channels 4, entering into the interior of the shoe and executing the desired ventilation function.

The outlet openings 12, through which the air flows 205, are also provided with convenient shutters 13 that function with a release, that can also be opened partially or closed by the user according to necessity, for example in the case of rain.

The hot air, sucked by means of the pressure difference, from the outlet openings 12, will be able to flow towards the interior of the shoe also passing by the holes 15 on the sole.

The induction of the internal ventilation of the footwear derives from the difference in pressure between two well defined areas: an area of high pressure placed in a front position on the footwear involving therefore the lateral frontal surface 1, and an area of low pressure that is created in the vicinity of the lateral-back surfaces of the shoe itself. The pressure difference existing between the area with high pressure and the area with low pressure creates the effect of the induction of fresh air and on the interior of the sole that is the object of the invention. Air is subsequently transmitted to the interior of the footwear itself for its natural passage by means of the holes 15 made on the insole 14.

Simultaneously, the hot air can flow from the holes 15 made on the insole. In this way, a continuous airflow is created on the interior of the footwear including the entry of fresh air and the exiting of hot air.

In a second practical embodiment, the airflow channels 4 can present an entirely rectilinear course.

I claim:

1. A shoe sole assembly comprising:

an insole having a plurality of holes formed therethrough;

a sole affixed to said insole, said sole having at least one inlet opening at a front end thereof and at least one outlet opening at a side thereof adjacent a back end thereof, said sole having continuous airflow channel formed therein so as to extend longitudinally therealong between the inlet opening and the outlet opening, the inlet opening positioned so as to face a higher air pressure than an air pressure faced by the outlet opening, said continuous airflow channel narrowing therealong so as to cause a Venturi effect on air passing from the inlet opening to the outlet opening, said plurality of holes of said insole communicating with said airflow channel;

a first shutter slidably mounted at the inlet opening and movable between a first position opening to said airflow channel and a second position closing said airflow channel; and a second shutter slidably mounted at the outlet opening and movable between a first position opening to said airflow channel and a second position closing said airflow channel.

2. The shoe sole assembly of claim 1, said at least one inlet opening comprising a pair of inlet openings positioned symmetrically with respect to a longitudinal axis of said sole.

3. The shoe sole assembly of claim 1, said at least one outlet opening comprising a pair of outlet openings positioned on opposite sides of said sole symmetrically with respect to a longitudinal axis of said shoe.

4. The shoe sole assembly of claim 1, said airflow channel extending longitudinally in a serpentine pattern in said sole, said plurality of holes of said insole having a corresponding serpentine pattern.

5. The shoe sole assembly of claim 2, said airflow channel comprising only a pair of channels extending longitudinally in a spaced relation to each other, said airflow channel having a single transverse channel extending in fluid communication between said pair of channels.

6. The shoe sole assembly of claim 1, said second position of said first shutter being in liquid-tight relation over the inlet opening, said second position of said second shutter being in liquid-tight relation over the outlet opening.

* * * * *